US010923848B2

(12) United States Patent
Ortega et al.

(10) Patent No.: US 10,923,848 B2
(45) Date of Patent: Feb. 16, 2021

(54) MODULAR BARREL CONTACT SYSTEM FOR ELECTRICAL CONNECTORS

(71) Applicant: Carlisle Interconnect Technologies, Inc., Kent, WA (US)

(72) Inventors: Jose Luis Ortega, Irving, TX (US); Sara Cook, Kent, WA (US); Bruce Lane, Tempe, AZ (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 0 days.

(21) Appl. No.: 16/712,852

(22) Filed: Dec. 12, 2019

(65) Prior Publication Data

US 2020/0194920 A1 Jun. 18, 2020

Related U.S. Application Data

(60) Provisional application No. 62/780,063, filed on Dec. 14, 2018.

(51) Int. Cl.
*H01R 13/436* (2006.01)
*H01R 4/20* (2006.01)

(52) U.S. Cl.
CPC ..... *H01R 13/4361* (2013.01); *H01R 4/20* (2013.01); *H01R 13/4367* (2013.01)

(58) Field of Classification Search
CPC ... H01R 13/4361; H01R 13/4367; H01R 4/20
See application file for complete search history.

(56) References Cited

U.S. PATENT DOCUMENTS 4,405,195 A * 9/1983 Cherry ..... H01R 13/193 439/825
4,723,925 A * 2/1988 Orr, Jr. ..... H01R 12/718 29/867
5,499,448 A * 3/1996 Tournier ..... H01R 4/183 29/862
6,764,350 B2 * 7/2004 Kosmala ..... H01R 13/65912 439/752
7,530,843 B1 * 5/2009 Tesfay ..... H01R 13/521 439/587
7,618,287 B2 * 11/2009 Hass ..... H01R 13/521 439/589

(Continued)

FOREIGN PATENT DOCUMENTS

EP 0584582 A1 3/1994
EP 0700125 A2 3/1996
JP 2008235210 A 10/2008

OTHER PUBLICATIONS

European Patent Office, Extended European Search Report for Application 19216195.8, dated Apr. 17, 2020, 9 pages.

*Primary Examiner* — Abdullah A Riyami
*Assistant Examiner* — Nader J Alhawamdeh
(74) *Attorney, Agent, or Firm* — Stoel Rives, LLP

(57) ABSTRACT

The disclosure relates to a modular barrel contact system suitable for use with a variety of electrical connectors. The contact system includes a barrel having an opening extending therethrough and designed to receive an electrical contact and a wire. When the barrel is crimped, the contact and wire are brought together with improved mechanical strength and electrical performance. The barrel includes features for securely inserting and retaining the contact system within a housing of the electrical connector.

16 Claims, 6 Drawing Sheets

(56) References Cited

U.S. PATENT DOCUMENTS

| | | | | |
|---|---|---|---|---|
| 7,695,331 | B2 * | 4/2010 | Kerner | H01R 4/72 439/877 |
| 9,997,875 | B2 * | 6/2018 | Roe | H01R 31/06 |
| 10,069,257 | B1 * | 9/2018 | Soubh | H01R 9/0527 |
| 10,446,969 | B2 * | 10/2019 | Bhat | H01R 13/4362 |
| 2003/0199205 | A1 * | 10/2003 | Kosmala | H01R 13/65912 439/752 |
| 2009/0117787 | A1 * | 5/2009 | Kerner | H01R 43/048 439/877 |
| 2020/0194920 | A1 * | 6/2020 | Ortega | H01R 13/4361 |

* cited by examiner

FIG. 5A
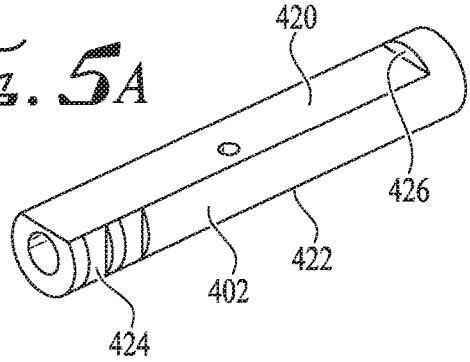
FIG. 5B
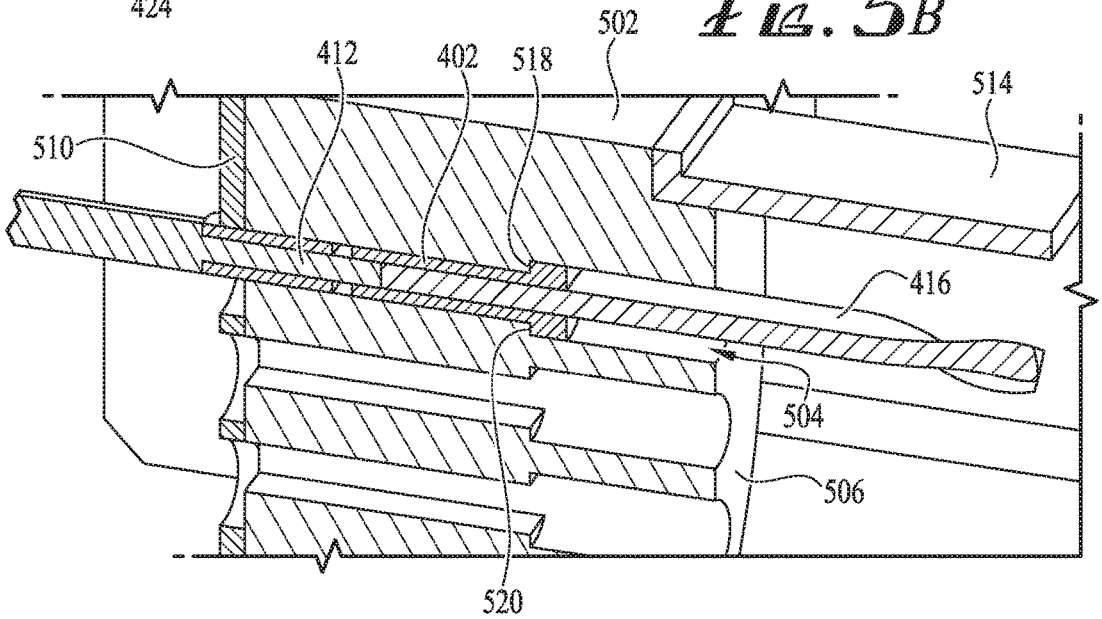
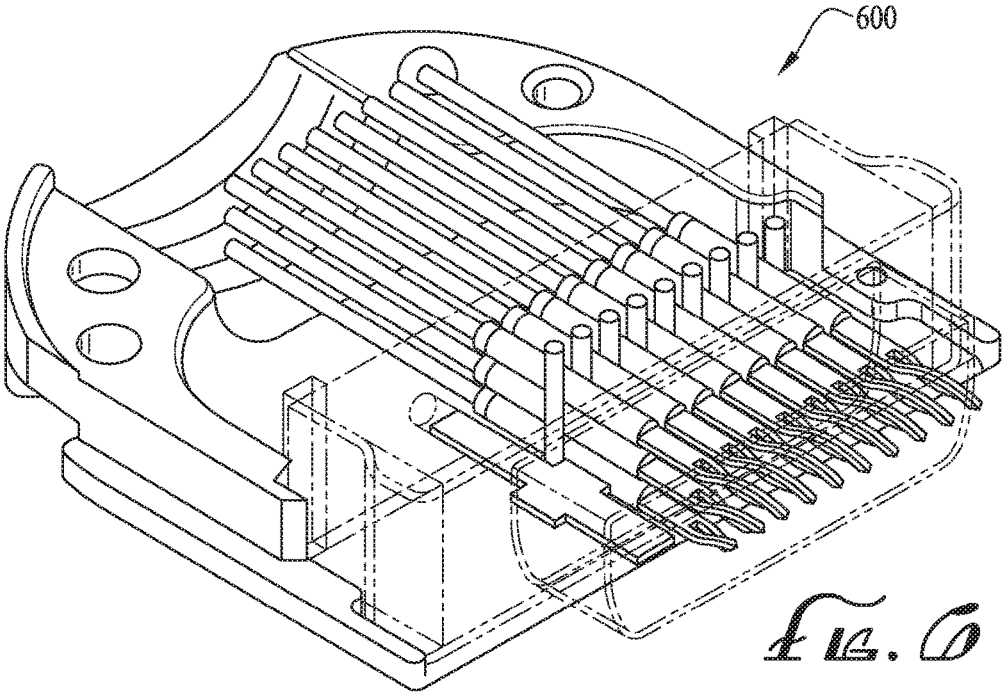
FIG. 6

MODULAR BARREL CONTACT SYSTEM FOR ELECTRICAL CONNECTORS

RELATED APPLICATION DATA

This application is a nonprovisional of and claims the benefit under 35 U.S.C. § 119(e) of U.S. Provisional Patent Application No. 62/780,063, filed Dec. 14, 2018, the disclosure of which is incorporated by reference herein in its entirety.

TECHNICAL FIELD

The field of this disclosure relates generally to electrical connectors and, in particular, to a streamlined design of a modular barrel contact system suitable for use with a variety of electrical connectors.

BACKGROUND

In the field of computers and technology, input/output (or I/O) interfaces are used to enable communication between computers, electronic devices, or other information processing systems. Typically, an I/O interface is the mechanism used for accommodating communications or information transfer between computers and electronic devices. In computing, there are several industry standard specifications that are commonly used for facilitating such communications. For example, electronic devices may include one or more Universal Serial Bus (USB) ports, High-Definition Multimedia Interface (HDMI) ports, or Digital Visual Interface (DVI) ports that can be used for transferring a variety of signals to and from electronic devices.

Each of these I/O interfaces has an industry standard arrangement of contacts that requires specialized connectors having a corresponding contact arrangement to establish successful communication between the devices. To facilitate large-scale volume manufacturing of the contacts for these standard I/O connectors, the contacts are typically machine-stamped and designed for cable wire attachment via soldering methods using high-heat soldering equipment. For most standard uses, this manufacturing process works well, and any wire repairs may be accomplished using soldering equipment in the field as needed.

In certain industries, such as aerospace, these conventional processes may be problematic for various reasons as high-heat soldering equipment may not be available to use for wire repairs due to safety concerns or onerous permit requirements. For example, with gasoline or other fuel on board the aircraft, high-heat equipment presents a high risk of resulting in catastrophic damage. Accordingly, the present inventors have recognized a need for crimpable wire-cable contacts that may be used in conjunction with any suitable electrical connector. In this arrangement, the contacts are designed for assembly and repair without requiring soldering (or other high-heat) equipment. The present inventors have also recognized a need for such contacts that are easily removable and replaceable as needed to facilitate repair efficiency. Additional aspects and advantages will be apparent from the following detailed description of preferred embodiments, which proceeds with reference to the accompanying drawings.

BRIEF DESCRIPTION OF THE DRAWINGS

FIGS. 4A, 4B, 5A, and 5B collectively illustrate various details of the electrical connector of FIG. 3 in accordance with an embodiment.

FIG. 6 illustrates details of another example embodiment of an electrical connector incorporating another multi-piece barrel contact system of FIG. 1.

DETAILED DESCRIPTION OF EXAMPLE EMBODIMENTS

Figure 1A:
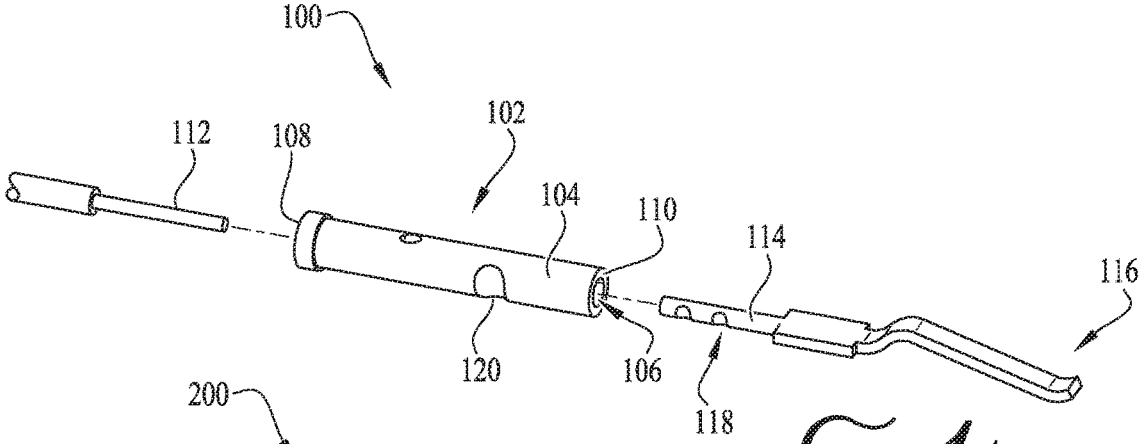
FIGS. 1A, 1B, 1C, and 1D collectively illustrate schematic views of various embodiments of a multi-piece barrel contact system.

With reference to the drawings, this section describes various embodiments of an electrical connector system and its detailed construction and operation. Throughout the specification, reference to "one embodiment," "an embodiment," or "some embodiments" means that a particular described feature, structure, or characteristic may be included in at least one embodiment of an electrical connector. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

The following describes example embodiments of a multi-piece barrel contact system and related components for electrical connectors that may be used in for aerospace applications, such as for aircraft electronic systems, or for any other suitable application. In the following description, certain components of the electrical connector system are described in detail. It should be understood that in some instances, well-known structures, materials, or operations are not shown or not described in detail to avoid obscuring more pertinent aspects of the embodiments. In addition, although the embodiments may reference electrical connectors having a specific arrangement of contacts, other embodiments may include differently configured components adapted to house more or fewer contacts in different arrangements than those illustrated.

With general reference to the figures, the following description relates to a multi-piece barrel contact system for electrical connectors as noted previous. In particular, the barrel contact system is designed for assembly without requiring soldering or the use of high-heat equipment to couple the cable wire and contacts. As further described in detail below, the system includes a crimp barrel designed to receive a contact on a front end and a cable wire on an opposite rear end. The crimp barrel includes notches or keys formed on its body, where the notches are designed for securing the crimp barrel and contact within a connector housing of the electrical connector during an assembly process. The notches on the crimp barrels may take any one of several suitable forms depending on the dimensions and features of the connector housing being used. As noted previously, the streamlined design of the crimp barrel facilitates repair in environments where soldering or high-heat equipment is unavailable or otherwise cannot be used. In addition, the modular design of the crimp barrel accommodates use of any one of a variety of contact configurations without requiring different crimping tools of assembly processes. Additional details and features of the barrel contact system and electrical connectors are provided below with reference to the figures.

FIGS. 1A, 1B, 1C, and 1D collectively illustrate various details of a multi-piece barrel contact system 100, 200, 300, 400 according to different example embodiments. Each of the contact systems 100, 200, 300, 400 may be used in conjunction with any one of a variety of electrical connectors as further described in detail below with reference to FIGS. 3-10. FIG. 2 is an enlarged, partially transparent view of one of the multi-piece barrel contact systems 300 illustrating crimping details in accordance with one embodiment. With collective reference to these figures, the following describes additional details of each of the multi-piece barrel contact systems 100, 200, 300, 400, followed by example configurations using these contact systems 100, 200, 300, 400 in various electrical connectors.

Figure 2:
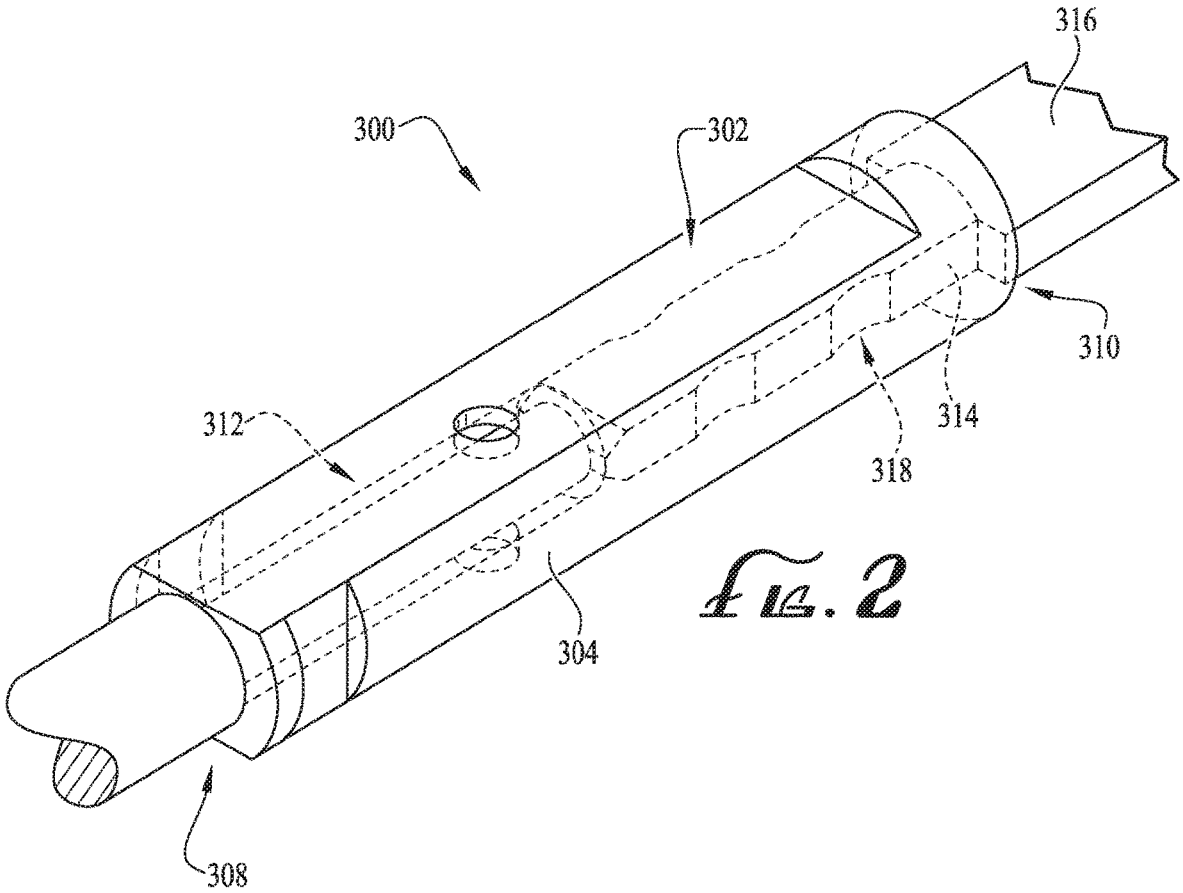
FIG. 2 is an enlarged, partially transparent view of the multi-piece barrel contact system of FIG. 1C illustrating crimping details in accordance with one embodiment.

With reference to FIG. 1A, the multi-piece barrel contact system 100 includes a crimp barrel 102 having a generally tubular body 104. The body 104 includes a cavity or lumen 106 extending therethrough and arranged along the longitudinal axis of the body 104. The cavity 106 has a first opening (not shown) positioned along a rear face 108 of the body 104, and includes a second opening positioned at an opposite front face 110 of the body 104. The opening at the rear face 108 is designed to receive a wire section 112 therethrough. Similarly, the second opening at the front face 110 is designed to receive an attachment portion or tab 114 of an electrical contact 116. In some embodiments, the attachment tab 114 includes various recesses or notches 118 formed thereon (e.g., slots, knurled sections, or other suitable cuts), where the recesses or notches 118 help create a gas tight seal within the crimp barrel 102 during the crimping process as further described below with particular reference to FIG. 2.

As illustrated in FIGS. 1A, 1B, 1C, and 1D, the contact 116 (or 216, 316, 416) may include any one of several contact front-end designs to allow the use of a singular crimp barrel 102 design (or a small sub-set of designs) for accommodating numerous different contact designs as needed for a suitable electrical connector. For example, with reference to FIG. 1B, the multi-piece barrel contact system 200 may include a similar crimp barrel 202 for accommodating an electrical contact 216 having a different front end design as compared to contact 116. The contact 216 may also have a unique attachment tab 214 with recesses or notches 218 arranged differently as compared to those of electrical contact 116. It should be understood, however, that despite these mechanical differences with the contact design, the functionality and characteristics of the overall multi-piece barrel contact systems remains substantially similar. Accordingly, it should be understood that although much of the focus of the written description relates to contact system 100 of FIG. 1A, the other illustrated contact systems 200, 300, 400 include the same or substantially similar characteristics.

Returning to multi-piece barrel contact system 100, the body 104 includes a cutaway region, illustrated as a slot 120, formed into a side surface of the body 104. As further discussed in detail below with particular reference to FIGS. 7-10, the cutaway region 120 on the body 104 may be used to retain the crimp barrel 102 and contact 116 in position within a housing of an electrical connector during the connector assembly process.

As noted previously, FIGS. 1B, 1C, and 1D collectively illustrate other embodiments of different crimp barrel and contact designs. As briefly described above, multi-piece barrel contact system 200 is similar to multi-piece barrel contact system 100, but includes a different front-end contact 216. Accordingly, the same details described previously with reference to contact system 100 may apply equally to contact system 200. With particular reference to FIGS. 1C and 1D, the multi-piece barrel contact systems 300, 400, however, include a modified crimp barrel design, the features of which are further described in detail below.

With reference to FIG. 1C, multi-piece barrel contact system 300 includes a crimp barrel 302 with a generally tubular body 304 having a similar arrangement as body 104 of FIG. 1A. For example, the body 304 includes a cavity or lumen (not shown) extending therethrough along its longitudinal axis, the cavity opening at a rear face 308 and at an opposite front face 310 of the body 304. The rear face 308 of the crimp barrel 302 is designed to receive a wire section 312, while the opening at the front face 310 is designed to receive an attachment tab (not shown) of an electrical contact 316. In some embodiments, the attachment tab may include various recesses or notches formed thereon similar to those described previously with reference to recesses/notches 118 (e.g., slots, knurled sections, or other suitable cuts), where the recesses or notches help create a gas tight seal within the crimp barrel 302 during the crimping process as further described below with reference to FIG. 2.

As illustrated in FIG. 1C, the body 304 of the crimp barrel 302 may have a substantially flat upper section 320 and opposite lower section 322. In addition, the body 304 may include one or more vertical slots 324 formed into a side surface of the body 304, the vertical slots 324 being generally perpendicular to the flat upper and lower sections 320, 322. As further discussed in detail below with particular reference to FIGS. 3-5, the flat upper and lower sections 320, 322 and slots 324 on the body 304 may be used to seat and retain the crimp barrel 302 and electrical contact 316 in position within a housing of an electrical connector after assembly.

In a similar fashion as described previously, the contact 316 may include any one of several contact front end designs, which allows the use of a singular or uniform crimp barrel 302 design for accommodating a variety of contacts as needed. For example, with reference to FIG. 1D, the multi-piece barrel contact system 400 may include a similar crimp barrel 402 for accommodating a contact 416 with a different front end design as compared to contact 316. The contact 416 may also have a unique attachment tab 414 with notches 418 arranged differently as compared to those of contact 316.

FIG. 2 is an enlarged, partially transparent view of one of the multi-piece barrel contact system 300 of FIG. 1C illustrating crimping details in accordance with one embodiment. With reference to FIG. 2, the following describes additional details relating to an example process for crimping the wire section 312 and electrical contact 316. As illustrated in FIG.

2, the wire section 312 is inserted into the body 304 via the opening (not shown) on the rear face 308, and the electrical contact 316 is inserted into an opposite side of the body 304 via the opening (not shown) on the front face 310. Both the wire section 312 and electrical contact 316 are pushed toward one another until they are fully seated in the crimp barrel 302, whereat an end of the wire section 312 contacts an end of the attachment tab 314 of the contact 316 as illustrated in FIG. 2.

Thereafter, the barrel 302 is crimped to achieve proper bonding of the components. When the barrel 302 is crimped, the material around the attachment tab 314 is deformed into and around the recesses or notches 318 for improved mechanical strength and to maintain good electrical performance. As mentioned previously, each of the crimp barrel and contact designs described in FIGS. 1A, 1B, 1C, and 1D, may be crimped in a similar fashion as described with reference to FIG. 2. The following sections provide additional details for inserting and securing the crimped barrel into an electrical connector in accordance with various embodiments.

Figure 3:
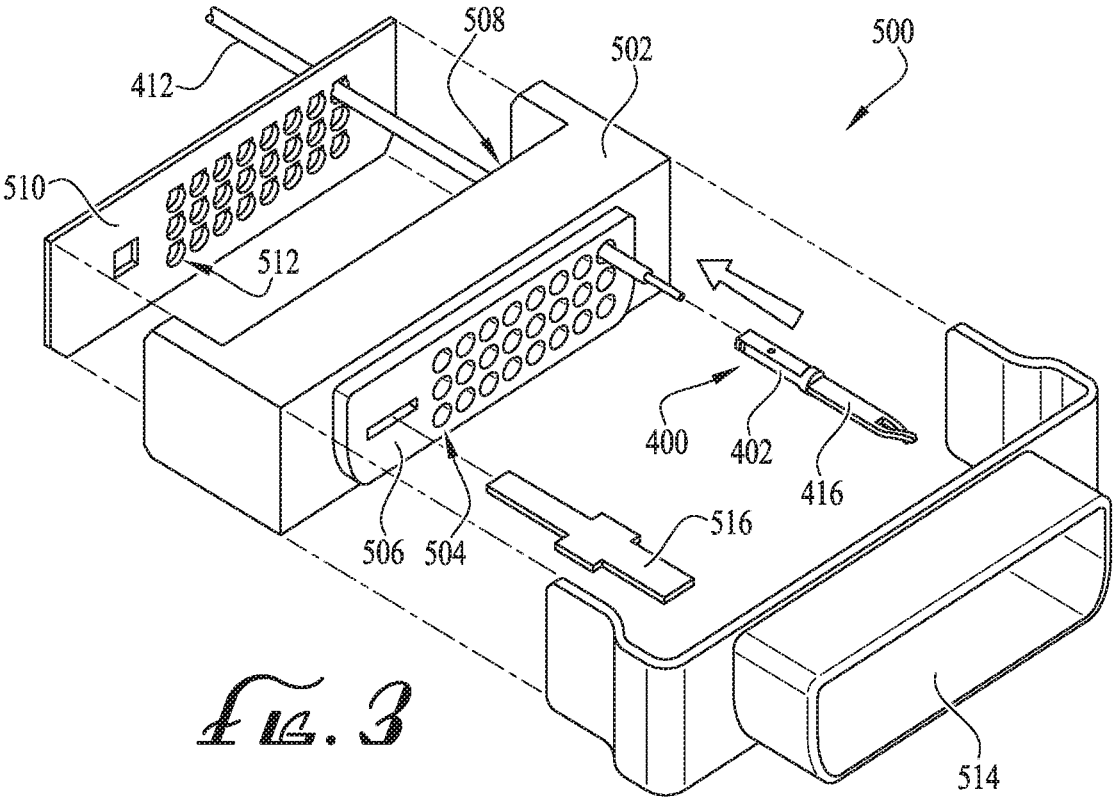
FIG. 3 is an exploded view of an electrical connector incorporating a multi-piece barrel contact system of FIG. 1 in accordance with an embodiment.

FIGS. 3-5 collectively illustrate various details of an electrical connector 500 incorporating the multi-piece contact barrel system 400 of FIG. 1D in accordance with one embodiment. With reference to FIG. 3, the electrical connector 500 is illustrated as a standard Digital Visual Interface (DVI) connector for connecting a video source to a display device. Briefly, the connector 500 includes a contact housing 502 having a plurality of contact-receiving cavities 504 extending through the contact housing 502 along a longitudinal axis from a rear face 508 toward a front face 506 of the housing 502. As illustrated, the cavities 504 open at both the front face 506 and the rear face 508 of the contact housing 502. In some embodiments, the cavities 504 may be aligned into an arrangement of columns and rows (illustrated as 8 columns and 3 rows for a total of 24 contact-receiving cavities for electrical connector 500). It should be understood that in other embodiments, such as for other connector types, the cavities 504 may be arranged differently.

The electrical connector 500 further includes a rear retention plate 510 configured to be coupled to the contact housing 502 along its rear face 508. The rear retention plate 510 includes a plurality of openings 512 formed thereon, the openings 512 arranged in a similar fashion as the openings of the cavities 504 on the rear face 508 of the contact housing 152. In an assembled configuration, the openings 512 of the rear retention plate 510 are aligned with the openings of the cavities 504 along the rear face 508 of the contact housing 502. The connector 500 further includes a shield 514 and a digital key 516, each mating with the contact housing 502 along its front face 506.

Figure 4A:
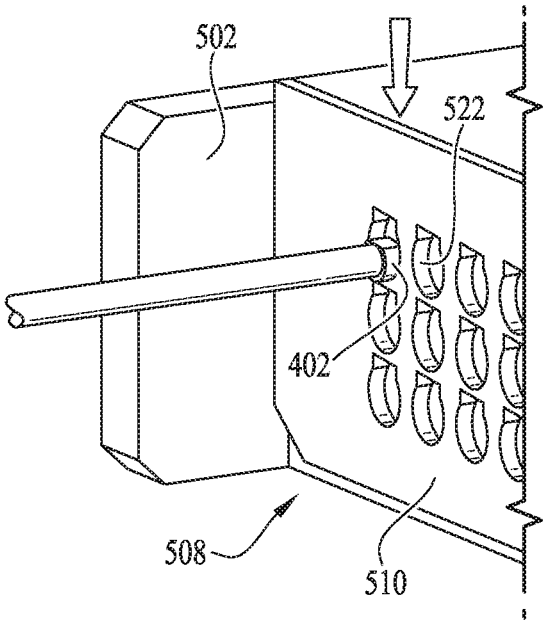
Figure 4B:
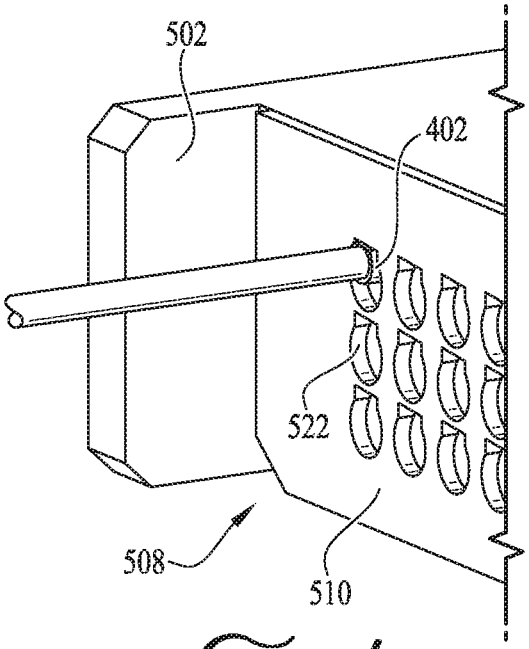

FIGS. 4A and 4B collectively illustrate enlarged views of the rear face 508 of the electrical connector 500. FIG. 5A illustrates a view of a barrel 402 of the contact system 400 and FIG. 5B is a cross-section view illustrating an example loading arrangement of the contact system 400 in the electrical connector 500. With collective reference to these figures, the following describes an example embodiment for securing the multi-piece contact barrel system 400 into the electrical connector 500.

As described previously with reference to FIG. 2, the wire 412, barrel 402, and contact 416 are crimped together to create the multi-piece barrel contact system 400. To begin the assembly process, the barrels 402 and contacts 416 are inserted into the contact-receiving cavities 504 via the openings on the front face 506 of the contact housing 502. During this front-loading process, the wires 412 are first inserted through the openings, followed by the barrels 402 and then the contacts 416.

As illustrated in FIG. 5A, and described previously with reference to other barrel embodiments, the barrels 402 may have a substantially flat upper section 420 and opposite lower section 422, where the flat upper and lower sections 420, 422 create a pair of shoulders 426 (bottom shoulder not shown) on the barrels 402. As the barrels 402 are loaded into the contact-receiving cavities 504, the shoulders 426 of the barrels 402 abut against internal stops 518, 520 formed on an interior portion of each of the cavities 504. The stops 518, 520 and shoulders 426 on the barrels 402 cooperate with one another to ensure that each of the barrels 402 and contacts 416 is located at a proper depth within the contact housing 502.

As noted previously, the barrels 402 each include one or more slots 424 formed along an end portion thereof (similar to slots 324 of barrel 302 described previously). When the barrels 402 are loaded onto the contact housing 502, an interior wall 522 adjacent the opening 512 on the retention plate 510 engages the slot 424 to further secure the barrel 402 and contact 416 in position along the rear face 508 of the connector 500 (see FIGS. 4A and 5B). Once all the contacts 416 are loaded into the contact housing 502, the retention plate 510 is driven downwardly to capture all the barrel slots 424 and contacts 416 in position (see FIG. 4B). With the retention plate 510 in position, the barrels 402 and contacts 416 are secured within the housing 502 of the electrical connector 500. When repairs are needed for damaged contacts 416, the retention plate 510 may be moved upwardly and select barrels 502 and contacts 416 pushed outwardly along the front face 508 of the electrical connector 500 for replacement.

Figure 1B:
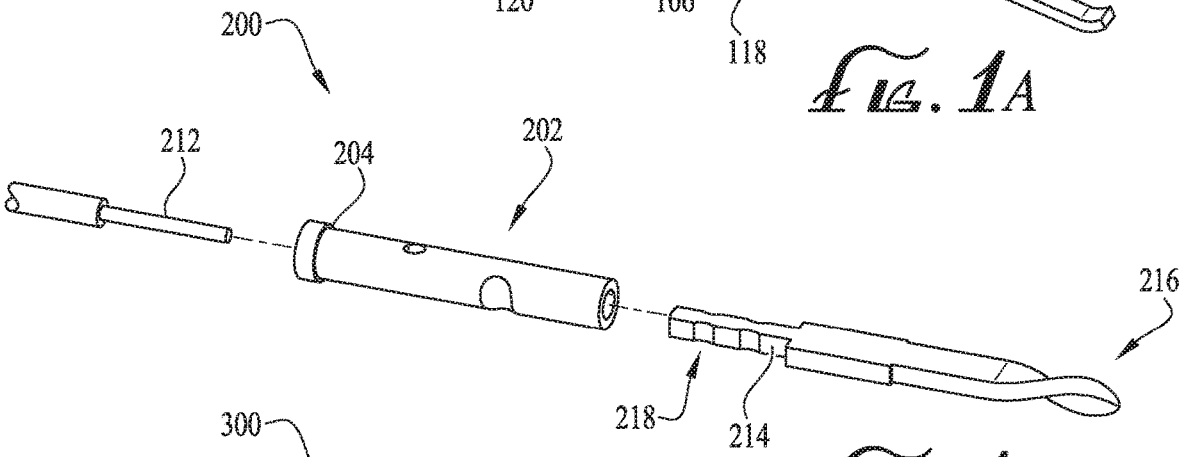
Figure 1C:
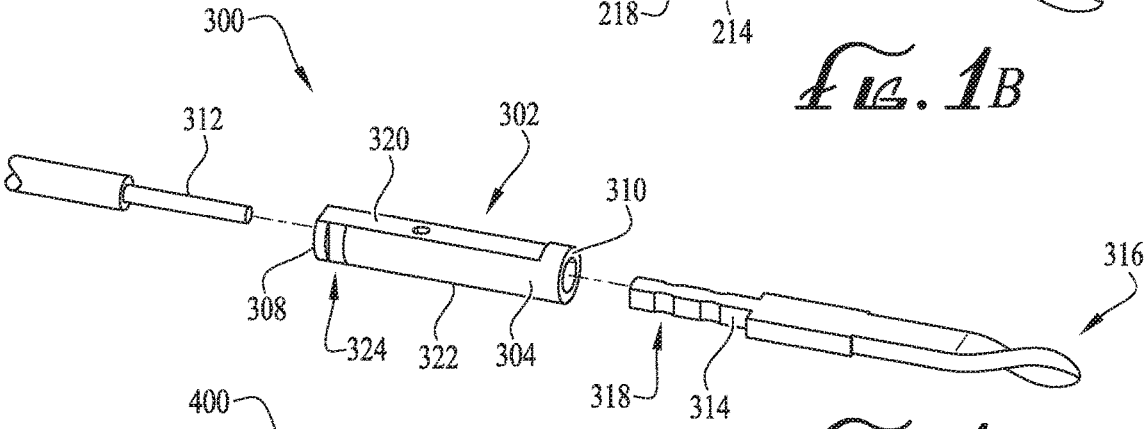
Figure 1D:
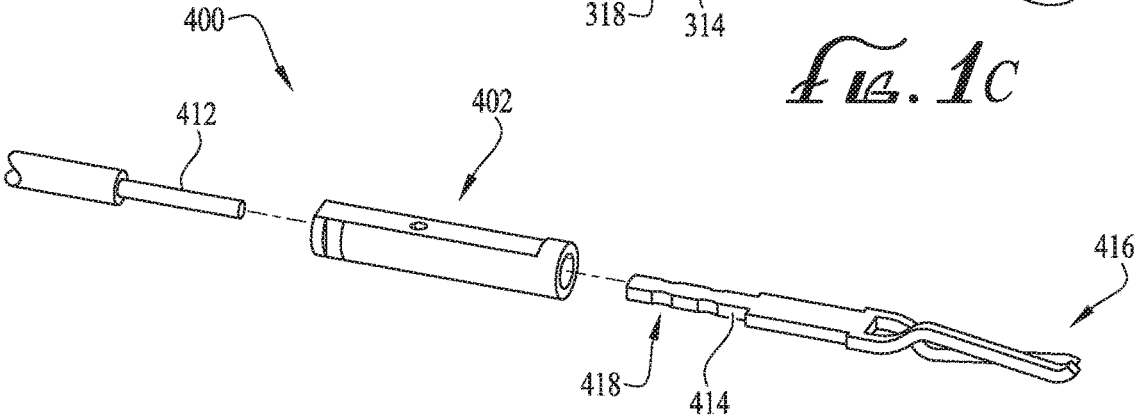
Figure 7:
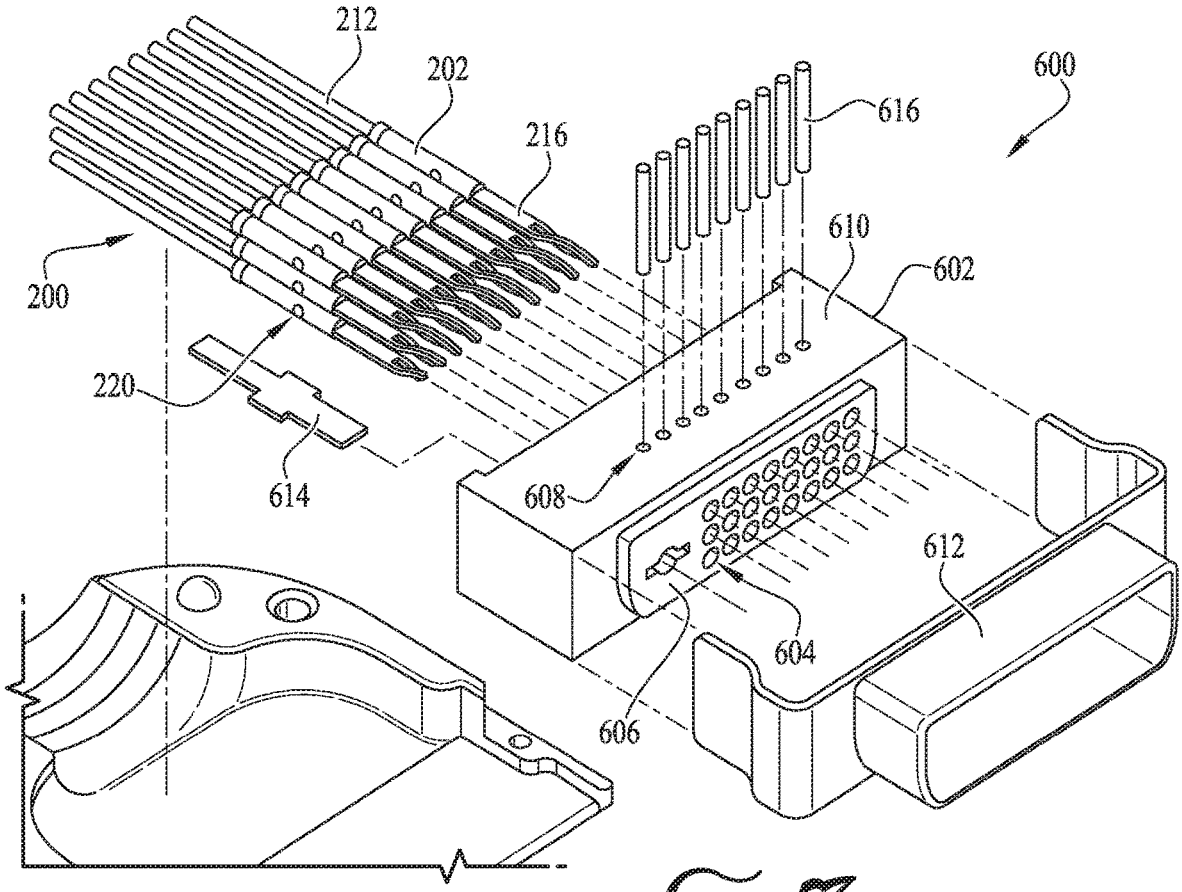
FIG. 7 is an exploded view of the electrical connector of FIG. 6.

FIGS. 6 and 7 collectively illustrate various details of another embodiment of an electrical connector 600 incorporating the multi-piece contact barrel system 200 of FIG. 1B. With reference to FIG. 6, the electrical connector 600 is illustrated as a Digital Visual Interface (DVI) connector for connecting a video source to a display device. The connector 600 includes a contact housing 602 having a plurality of contact-receiving cavities 604 extending through the body of the contact housing 602, where the cavities 604 open onto a front face 606 and a rear face (not shown) of the contact housing 602 in a similar fashion as described with reference to the electrical connector 500 of FIG. 3. As illustrated in FIG. 7, the cavities 604 are aligned into an arrangement of columns and rows (illustrated as 8 columns and 3 rows for a total of 24 contact-receiving cavities). The contact housing 602 further includes a plurality of openings 608 formed along a top surface 610 of the contact housing 602, the top surface 610 being generally orthogonal to the front face 606 of the contact housing 602. The connector further includes a shield 612 and a digital key 614. With particular reference to FIGS. 6 and 7, the following describes an example embodiment for loading and securing the multi-piece contact barrel system 200 into the electrical connector 600.

With reference to FIG. 7, the contacts 216 and wire 212 are crimped together as described previously with reference to FIG. 2, and are thereafter loaded onto the contact housing 602 via its rear face. During the loading process, the barrels 202 are arranged such that the notches or slots 220 formed on the side of the barrels 202 are aligned relative to one another and align with a respective opening 608 formed on the top surface 610 of the connector housing 602. Once all the contacts 216 are loaded into the contact housing 602, a retaining pin 616 is inserted into the contact housing 602 via each of the openings 608. The retaining pins 616 extend through the contact housing 602 and engage the respective slots 220 of the barrels 202, thereby securing the contacts 216 in position.

In some embodiments, the barrels 202 may each further include a shoulder or stop 204 formed along an end thereof (see FIG. 1B). The shoulder 204 may be formed as a diameter step change in the barrel body, where the barrel 202 has a substantially uniform diameter through most of the body, but has a larger diameter adjacent an end thereof to form the shoulder 204. In other embodiments, the shoulder 204 may be formed via other suitable means. In operation, the shoulder 204 may abut against an interior wall or shoulder (not shown) formed within the contact housing 602 to retain the barrel 202 in position and ensure proper alignment and depth of the barrel 202 and contact 216 prior to securing the retaining pins 616.

Figure 8:
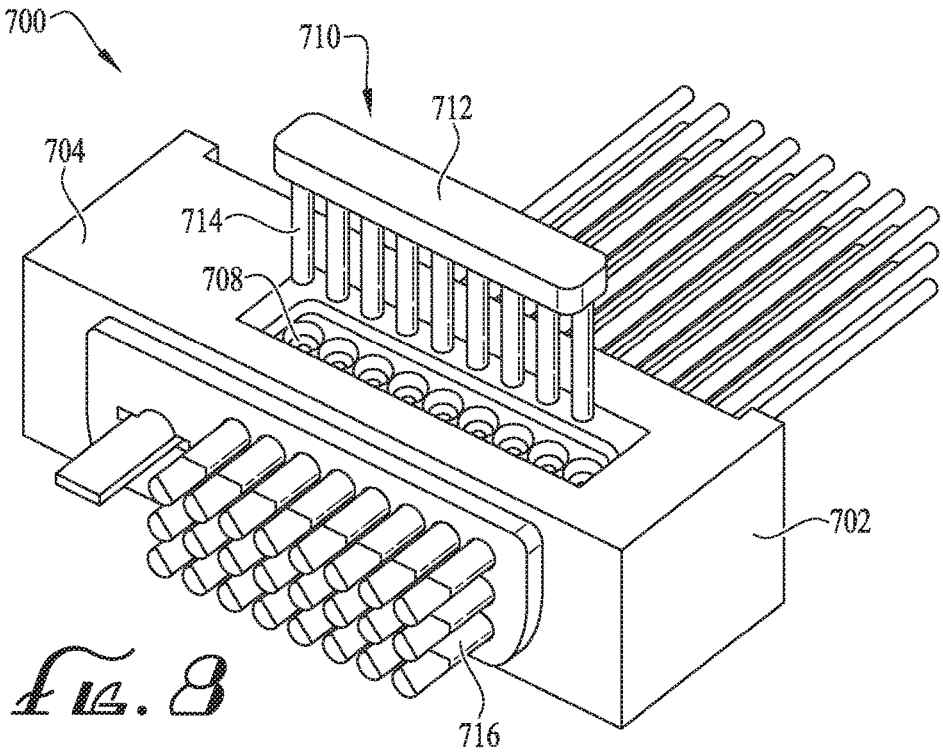
FIG. 8 illustrates a perspective view of another example embodiment of an electrical connector.

FIG. 8 illustrates a variation on the embodiment of FIGS. 6 and 7. With reference to FIG. 8, the electrical connector 700 includes a contact housing 702 with a plurality of contact-receiving cavities (not shown) having contacts 716 therein in a similar fashion as described previously with reference to the electrical connector 600 of FIGS. 6 and 7. It should be understood that many of the same features of the housing 602 of the electrical connector 600 may be present in the housing 702 of the electrical connector 700. Accordingly, those features are not further described herein to avoid obscuring more pertinent aspects of the embodiment. With reference to FIG. 8, the contact housing 702 may include a plurality of openings 708 formed along a top surface 704 of the contact housing 702. The electrical connector 700 further includes a key 710 having an elongated base 712 and a plurality of retaining pins 714 extending upwardly from the base 712 such that the pins 714 are generally perpendicular to the base 712. Preferably, the pins 714 are formed as integral components of the base 712, but in other embodiments may be separate components affixed to the base 712.

In an example assembly operation, the contacts 716 are loaded into the contact-receiving cavities of the contact housing 702 in a similar fashion as described previously with reference to FIGS. 6 and 7. Once the contacts 716 are loaded, the key 710 may be positioned above the openings 708 and moved downwardly until the pins 714 are inserted into the openings 708 to engage the slots (not shown) on the crimp barrels (not shown) in a similar fashion as described previously to secure the contacts 716 in position.

Figure 9:
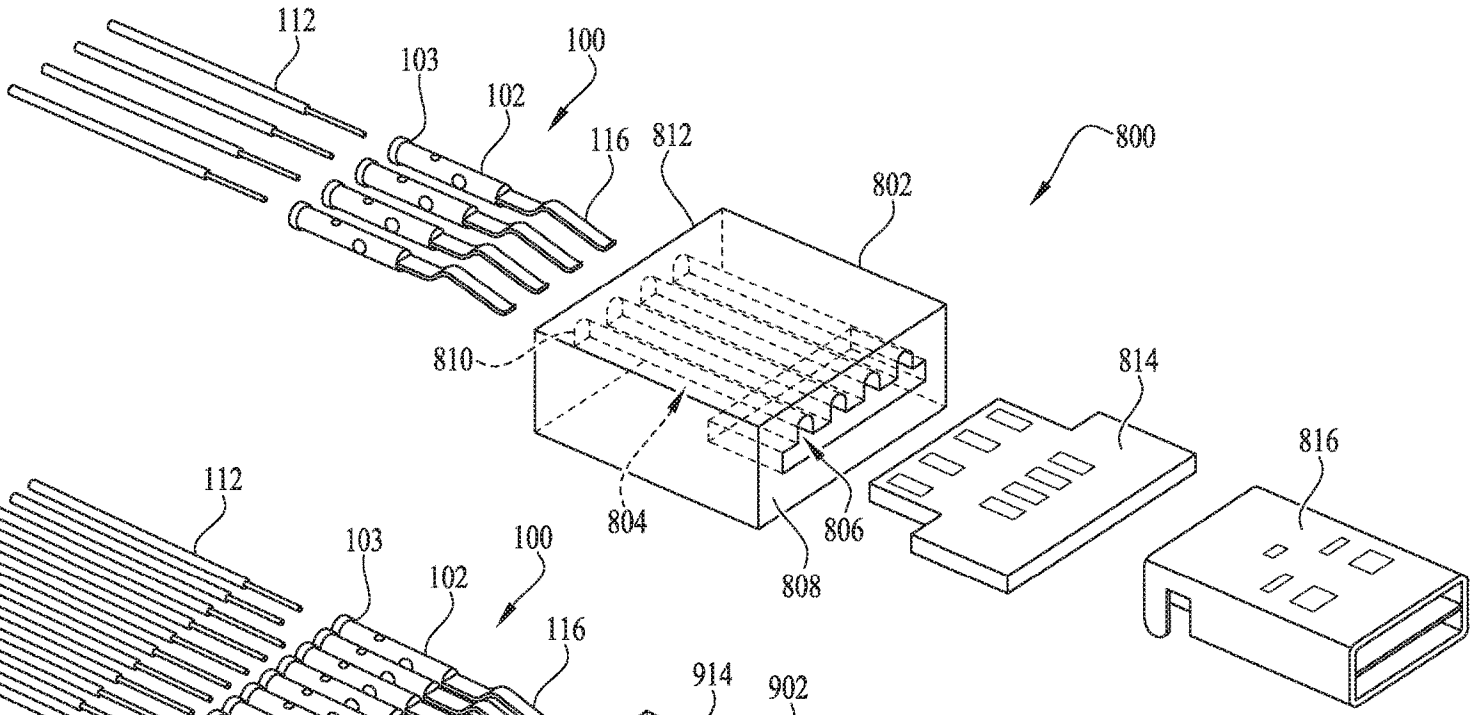
FIG. 9 illustrates an exploded view of yet another example embodiment of an electrical connector incorporating the multi-piece barrel contact system of FIG. 1A.

FIG. 9 illustrates various details of another embodiment of an electrical connector 800 incorporating the multi-piece contact barrel system 100 of FIG. 1A. With reference to FIG. 9, the electrical connector 800 is illustrated as a USB 2.0/3.0 Type A Cable Plug. The connector 800 includes a thermoplastic contact housing 802 having a plurality of contact-receiving cavities 804 extending longitudinally therethrough, the cavities 804 having openings 806 on a front face 808 and openings 810 on a rear face 812 of the contact housing 802. In some embodiments, the contact housing 802 further includes a plurality of openings (not shown) formed along a top surface of the contact housing 802, the openings designed to receive retaining pins (such as retaining pins 616 or key 710 with retaining pins 714) to retain the multi-piece contact barrel system 100 in position in a similar manner as described previously with reference to the embodiments of FIGS. 7 and 8. The connector 800 further includes a transition paddle card 814 and a plug 816 coupled to the card 814. Preferably, the card 814 and plug 816 are supplied pre-soldered as one assembly to avoid the need to solder these components in the field. In some embodiments, the barrels 102 may further include a shoulder or other stop feature 103 formed along an end thereof in a similar fashion as stop feature 204 described previously. With particular reference to FIG. 9, the following describes an example embodiment for loading the multi-piece contact barrel system 100 into the electrical connector 800.

During an assembly process, the contacts 116 (e.g., stamped cantilever contacts) and wire 112 (e.g., 24-28 AWG wire) are crimped together and loaded onto the contact housing 802 via the openings 810 on the rear face 812 of the contact housing 802. During the loading process, the barrels 102 are advanced into the contact-receiving cavities 804 until the shoulder 103 abuts against the rear face 812 of the contact housing 802. The shoulder 103 cooperates with the rear face 812 to retain the barrel 102 in position and ensure proper alignment of the contacts 116.

Figure 10:
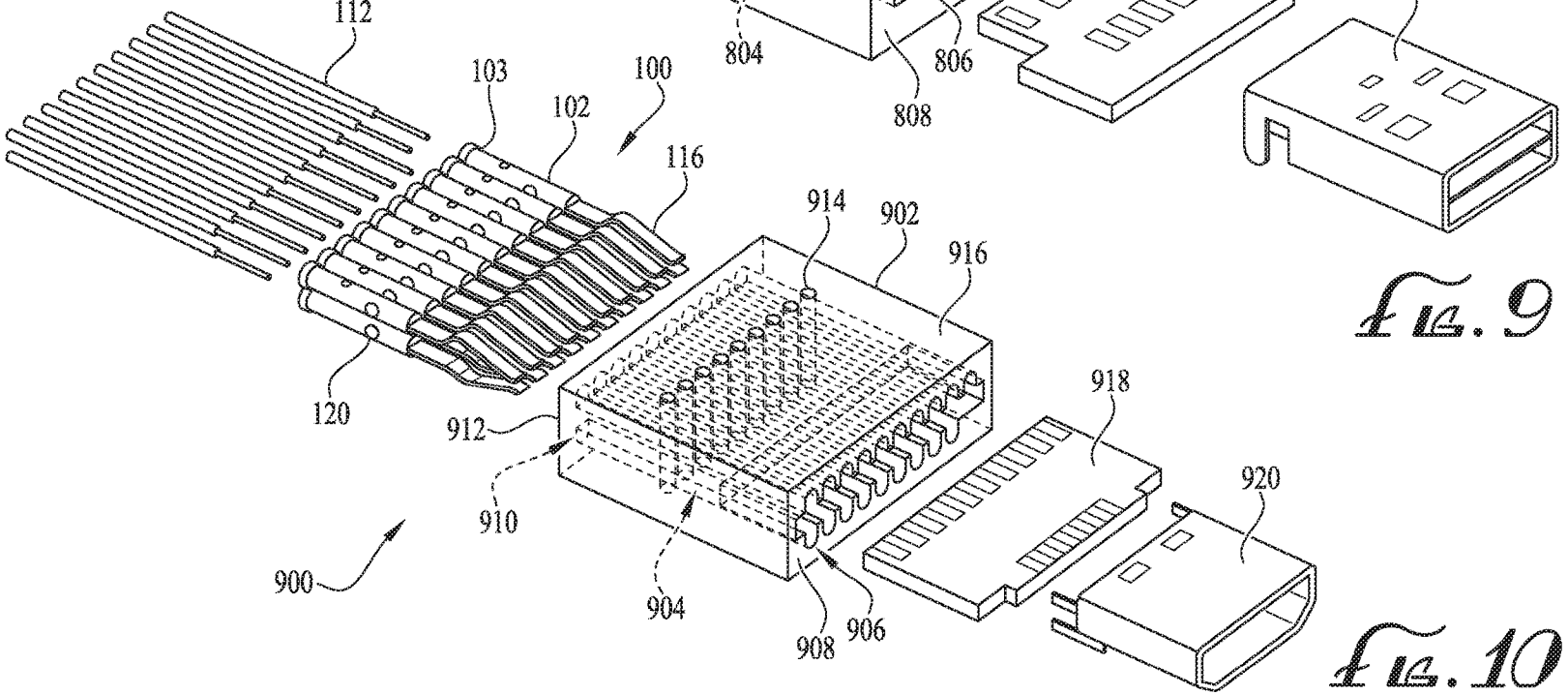
FIG. 10 illustrates perspective and exploded views of another example embodiment of an electrical connector incorporating another of the multi-piece barrel contact systems of FIG. 1.

FIG. 10 illustrates various details of another embodiment of an electrical connector 900 incorporating the multi-piece contact barrel system 100 of FIG. 1A. With reference to FIG. 10, the electrical connector 900 is illustrated as an HDMI Type A Cable Plug. The connector 900 includes a thermoplastic contact housing 902 having a plurality of contact-receiving cavities 904 extending longitudinally therethrough, the cavities 904 having openings 906 on a front face 908 and openings 910 on a rear face 912 of the contact housing 902. As illustrated, the cavities 904 are aligned into an arrangement of columns and rows (illustrated as 2 rows and 10 columns for a total of 20 contact-receiving cavities). The contact housing 902 further includes a plurality of openings 914 formed along a top surface 916 of the contact housing 902, the top surface 916 being generally orthogonal to the front face 908 of the contact housing 902. The connector 900 further includes a transition paddle card 918 and a plug 920 coupled to the card 918. In some embodiments, the barrels 102 may further include a shoulder or other stop feature 103 formed along an end thereof in a similar fashion as described previously with reference to FIG. 9. With particular reference to FIG. 10, the following describes an example embodiment for loading the multi-piece contact barrel system 100 into the electrical connector 900.

During an assembly process, the contacts 116 (e.g., stamped cantilever contacts) and wire 112 (e.g., 24-32 AWG wire) are crimped together and loaded onto the contact housing 902 via the openings 910 on the rear face 912 of the contact housing 902. As the contacts 116 are loaded, the barrels 102 are arranged such that the notches or slots 120 formed on the side of the barrels 102 are aligned relative to one another and aligned with a respective opening 914 on the top surface 916 of the connector housing 902. The barrels 102 are advanced into the contact-receiving cavities 904 until the shoulder 103 abuts against the rear face 912 of the contact housing 902. In this configuration, the shoulder 103 and the rear face 912 together retain the barrel 102 in position and ensure proper alignment of the contacts 116. Once all the contacts 116 are loaded, retaining pins (not shown) are inserted into the contact housing 902 via the openings 914 in a similar fashion as described with reference to FIGS. 7 and 8. The retaining pins engage the slots 120 on the barrels 102 to retain the contacts 116 in position within the contact housing 902 in a similar fashion as described previously.

As described, the disclosed subject matter provides details for a crimpable, multi-piece barrel contact system that can be used for a variety of electrical connector systems, such as DVI, HDMI, and USB connectors. The multi-piece barrel contact system provides common barrel designs that can accommodate any one of a variety of suitable contacts designs as needed for particular electrical connectors to maximize flexibility in design and compatibility with various connector types. In addition, the disclosed system provides a design for crimpable wire-cable contacts that may be used in conjunction with any suitable electrical connector, where the contacts are designed for assembly and repair without requiring soldering (or other high-heat) equipment.

Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable. The terms and descriptions used above are set forth by way of illustration only and are not meant as limitations. It will be obvious to those having skill in the art that many changes may be made to the details of the above-described embodiments without departing from the underlying principles of the invention. Those having skill in the art should understand that other embodiments than those described herein are possible.

The invention claimed is:

1. An electrical connector comprising:

a housing including a front face and an opposite rear face, the housing further including a plurality of contact-receiving cavities extending in an axial direction from the front face to the rear face; and a plurality of barrel contact systems, each barrel contact system comprising:

a barrel body having a cavity extending in an axial direction from a front face of the barrel body to an opposite rear face;

a wire section disposed within the barrel body, a portion of which extending outwardly from the rear face of the barrel body; and an electrically conductive contact having an attachment tab, the attachment tab disposed within the barrel body along the front face and abutting the wire section, the electrically conductive contact extending outwardly from the barrel body, wherein the wire section and attachment tab are crimped together within the barrel body, and wherein each barrel contact system is received in a corresponding one of the contact-receiving cavities of the housing, and wherein the wire section extends outwardly along the rear face of the housing and the electrically conductive contact extends outwardly along the front face of the housing.

2. The electrical connector of claim 1, the barrel body further including one or more slots formed thereon, the electrical connector further comprising one or more fastening mechanisms, wherein the fastening mechanisms engage with the one or more slots on the barrel body to secure the barrel body within the housing.

3. The electrical connector of claim 1, wherein the barrel body further includes a shoulder formed along an end thereof, the shoulder engaging a corresponding stop formed in the housing to restrain movement of the barrel body along the axial direction within the contact-receiving cavity for securely seating the barrel body within the housing.

4. The electrical connector of claim 1, wherein the barrel body further includes a recess formed thereon, and wherein the housing further includes one or more slots formed along a surface of the housing, the electrical connector further comprising one or more securement mechanisms, each securement mechanism extending through a corresponding one of the slots on the surface of the housing and engaging the recess on the barrel body to secure the barrel body within the housing of the electrical connector.

5. The electrical connector of claim 4, wherein the one or more securement mechanisms are coupled to one another via a common base to form an integral, unitary component.

6. The electrical connector of claim 1, wherein the attachment tab further includes one or more recessed regions formed thereon, the recessed regions disposed within the cavity of the barrel body.

7. The electrical connector of claim 1, the electrical connector further comprising a retention plate having a plurality of openings formed thereon, the openings aligning with the contact-receiving openings on the housing when the retention plate is coupled to the rear face of the housing.

8. The electrical connector of claim 7, wherein the barrel body further includes a shoulder formed along an end thereof, and wherein the shoulder engages with a wall surrounding the opening of the retention plate to secure the barrel body within the housing.

9. The electrical connector of claim 1, wherein the barrel body further includes a shoulder formed along the front face thereof adjacent the electrically conduct contact, the shoulder engaging a corresponding stop formed within the contact-receiving cavity to secure the barrel body in position within the housing.

10. The electrical connector of claim 1, the barrel body further including a first opening and second opening formed thereon, the openings arranged generally orthogonal relative to the cavity of the barrel body.

11. A barrel contact system for an electrical connector, the contact system comprising:

a barrel body having a cavity extending in an axial direction from a front face of the barrel body to an opposite rear face;

a wire section disposed within the barrel body, a portion of which extending outwardly from the rear face of the barrel body; and an electrically conductive contact having an attachment tab, the attachment tab disposed within the barrel body along the front face and abutting the wire section, the electrically conductive contact extending outwardly from the barrel body, wherein the wire section and attachment tab are crimped together within the barrel body.

12. The system of claim 11, the barrel body further comprising a shoulder formed adjacent one of the front and rear faces of the barrel body for securing the barrel body in a contact-receiving cavity of the electrical connector.

13. The system of claim 11, the barrel body further comprising one or more slots formed thereon for securing the barrel body in a contact-receiving cavity of the electrical connector.

14. The system of claim 13, the barrel body further comprising a first substantially planar surface and an opposite second substantially planar surface, wherein the one or more slots each extend along the barrel body from the first substantially planar surface to the second substantially planar surface.

15. The system of claim 11, wherein the attachment tab further includes one or more recessed regions formed thereon, the recessed regions disposed within the cavity of the barrel body.

16. The system of claim 11, the barrel body further including a first opening and second opening formed thereon, the openings arranged generally orthogonal relative to the cavity of the barrel body.

* * * * *